US011848511B2

(12) United States Patent
Jarvis et al.

(10) Patent No.: US 11,848,511 B2
(45) Date of Patent: Dec. 19, 2023

(54) ELECTRICAL PLUG SAFETY BOOT

(71) Applicants: Adrian Mathew Jarvis, Burnaby (CA); Yashovardhan Dobriyal, New Westminster (CA)

(72) Inventors: Adrian Mathew Jarvis, Burnaby (CA); Yashovardhan Dobriyal, New Westminster (CA)

( * ) Notice: Subject to any disclaimer, the term of this patent is extended or adjusted under 35 U.S.C. 154(b) by 0 days.

(21) Appl. No.: 17/548,491

(22) Filed: Dec. 11, 2021

(65) Prior Publication Data

US 2023/0361500 A1 Nov. 9, 2023

(51) Int. Cl.
*H01R 13/447* (2006.01)

(52) U.S. Cl.
CPC ..... *H01R 13/447* (2013.01)

(58) Field of Classification Search
CPC ... H01R 13/447; H01R 13/44; H01R 13/4538
See application file for complete search history.

(56) References Cited

U.S. PATENT DOCUMENTS 2,458,153 A * 1/1949 Festge ..... H01R 13/4538 439/588
2,759,160 A * 8/1956 Kelley ..... H01R 13/447 439/588
3,629,790 A * 12/1971 McSherry, Jr. ..... H01R 13/447 439/140
4,810,199 A * 3/1989 Kar ..... H01R 13/44 439/588
7,011,535 B2 * 3/2006 Dickie ..... H01R 13/44 439/141
8,770,994 B1 * 7/2014 Fagan ..... H01R 13/44 439/141
10,454,215 B2 * 10/2019 Watkins, Jr. ..... H01R 13/6395

FOREIGN PATENT DOCUMENTS

CN 104283038 A * 1/2015 ..... H01R 13/44
CN 106602328 A * 4/2017

* cited by examiner

*Primary Examiner* — Tho D Ta

(57) ABSTRACT

This electrical plug safety boot is used to protect children and other household occupants from electrical shocks while inserting or removing the plug from an electrical receptacle or in case a child tries to touch the prongs of the plug while the plug is half way out intentionally or accidentally. A unique aspect of the present invention is that this safety boot conveniently fastens to any existing electrical plug with or without a ground prong and does not have to be manufactured with the electrical plug. The invention is an elastically collapsible electrically insulating boot which mounts around the prongs and prevents fingers from touching them.

7 Claims, 3 Drawing Sheets

ELECTRICAL PLUG SAFETY BOOT

BACKGROUND OF THE INVENTION

Children sometimes play with electrical outlets and plugs in the home. In play a child can stick his or her fingers or tongue or any other body part near a partially inserted plug and make contact with the prongs exposing the child to severe electrical shock. Such a shock can injure or possibly kill the child. Adults also can face a shock hazard inserting the plug into a receptacle by touch in the dark or around an obstacle. Many devices have been created to protect the children and adults from these hazards.

In U.S. Pat. No. 4,305,634 to Lewis, indicates a device with offset slots which twist the plug electrical prongs providing a tighter grip in the outlet but repeated use will permanently bend and loosen the contacts inside the outlet. Also since the protective disc is not flexible it is made larger to provide adequate protection but this means that these plugs cannot be used close together in a power bar.

In U.S. Pat. No. 4,810,199 to Kar, various hoods are employed to block fingers from contacting the live electrical prongs but these various embodiments all require specially adapted plugs but this is not universally adaptable to existing electrical plugs.

In U.S. Pat. No. 4,531,800 to Avener, a device is attached to an electrical outlet and plug to prevent children from pulling out the plug. The invention of this patent is believed to be effective but requires the installation of a special wall receptacle or receptacle cover plate.

In U.S. Pat. No. 3,982,084 to cooperstien, a specially modified electrical receptacle is described wherein electrical contact with the prongs of the plug is not made until the plug is fully inserted into the receptacle. The invention of this patent is also believed to be effective but required the installation of a special receptacle and the use of a non-standard plug having an additional non-conducting prong which cooperates with the special receptacle.

U.S. Pat. No. 4,340,267 to Nakuga, describes a plug having a spring-loaded prong covering member is automatically retracted in such a way that the exposed portions of the prongs are covered when the plug is partially inserted into the receptacle. The invention of this patent does not require the replacement of the standard household electrical receptacle and is believed to be effective. However, its construction involves a number of parts which is believed to increase its cost of manufacture.

BRIEF SUMMARY OF THE INVENTION

The present invention is an electrical plug safety boot which may be in the form of a curved flexible insulating disc which adheres to any common electrical plug to protect people from electrocution. The safety boot in general is an object to block finger contact from live electrical plug prongs. It can be installed on standard electrical plugs with or without ground prong. It comprises an electrically insulating flexible body made of silicone rubber or materials with similar properties. It can also be comprised of 2 different materials such as a high temperature flat center disc and contiguous flexible surrounding flaps or circumferential hood. It can be configured to mechanically bind to the prongs of the electrical plug and or adhere to the body of the same plug with adhesive or other method. The flaps or hood would be thereby affixed towards the centre of the electrical plug but free to flex at their extremity. The hood or flaps surround the electrical prongs and extend forwards longitudinally at least one half of the length of the electrical prongs thereby blocking fingers from touching them while the plug is partly inserted into the outlet. When the plug is completely inserted the safety boot flattens against the outlet.

DETAILED DESCRIPTION OF THE INVENTION

Figure 1:
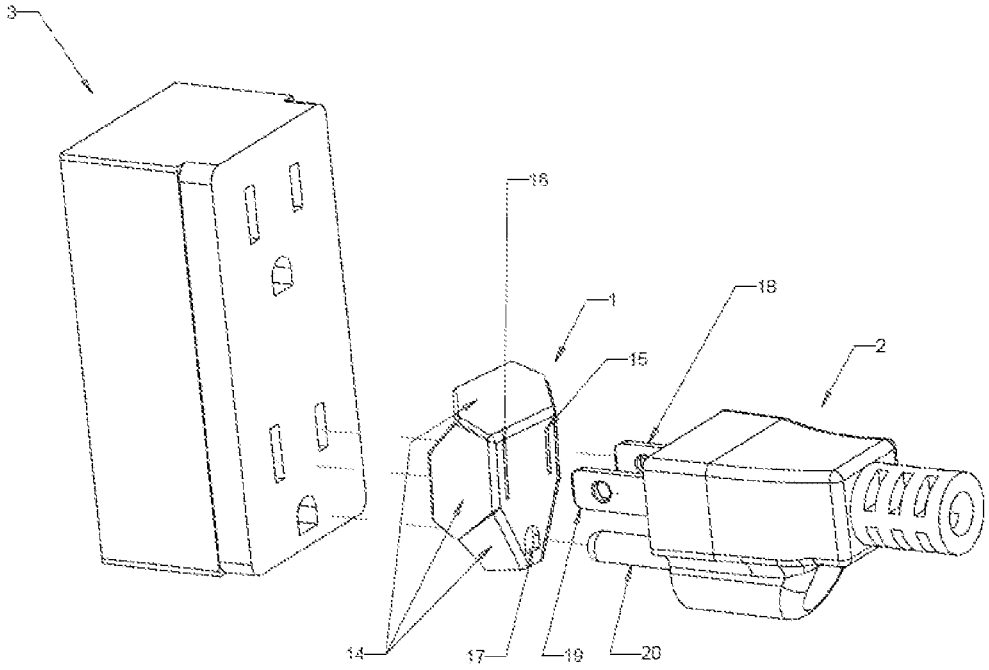
FIG. 1 is an exploded isometric view of a Nema 5-15 plug and socket with one type of this present safety boot shown between them.

Referring now to FIG. 1, therein is shown a Nema 5-15 electrical plug 2, one type of electrical safety boot 1 and an electrical outlet 3. These are shown in exploded isometric form. The plug comprises an existing insulating body with electrically conducting prongs which serves as a mounting base for the electrical plug safety boot. The electrical plug safety boot holes can be slightly smaller than the two or three electrical prongs in order to permit an interference fit to prevent the safety boot sliding off the electrical prongs. This means slot 15 is smaller than prong 18, slot 16 is smaller than prong 19 and hole 17 is smaller than prong 20. For the same reason the three holes in the electrical plug safety boot can be arranged slightly closer together than the electrical prongs. This means holes grouping of 15, 16 and 17 in the electrical safety boot is slightly closer together than the electrical prongs 18, 19 and 20. The electrical safety boot can be made of single or combinations of material with various characteristics including flexibility, high melting temperature, fire resistance, electrical insulation, mechanical strength, transparency, chemical compatibility with adhesives or other characteristics. The surrounding flexible flaps 14 are shown in the extended position as the plug has not yet been inserted in the electrical outlet.

Figure 2:
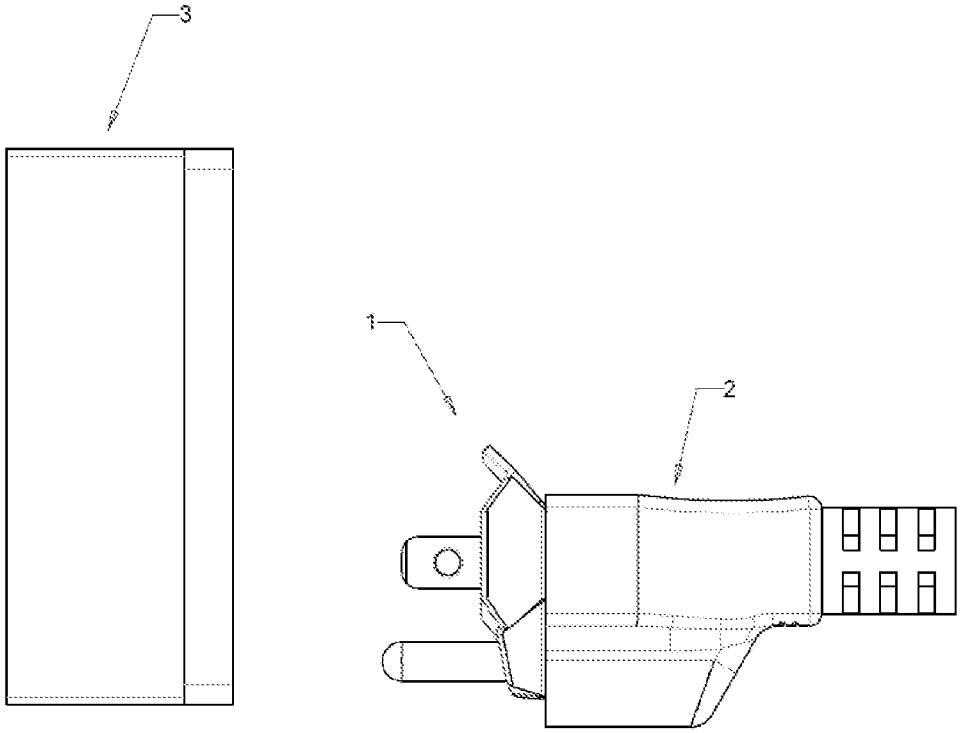
FIG. 2 is an exploded side view of a Nema 5-15 plug and socket with one type of this present safety boot shown adhered to the plug.
Figure 3:
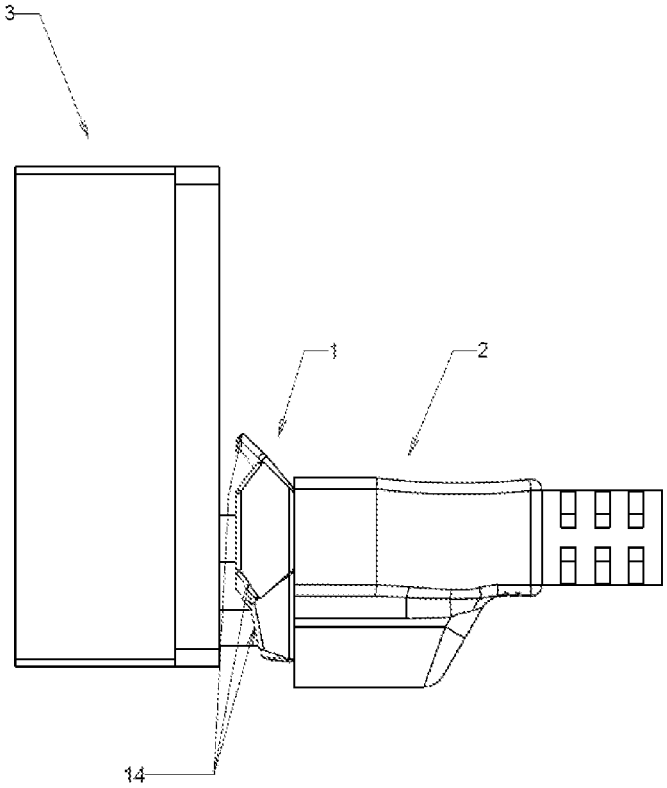
FIG. 3 is a Nema 5-15 plug with one type of safety boot installed being partially inserted into an electrical outlet.

Referring now to FIG. 2, therein is shown the Nema 5-15 plug with the electrical safety boot installed to its prongs possibly with interference fit and peel off-stick on adhesive strip a possibility as well. Also is shown the electrical plug safety boot body 1 and flaps 2. The flaps may be transparent to more easily locate the plug prongs to the outlet. The flaps in this position extend approximately half way the longitudinal length of the electrical prongs Referring now to FIG. 3, therein the plug prongs are beginning to contact the electrical contacts inside the outlet and are therefore energized. In this position and at this time the flaps 14 are blocking potential contact between fingers and prongs and will continue to substantially cover the prongs from this position to the completely plugged in position.

Figure 4:
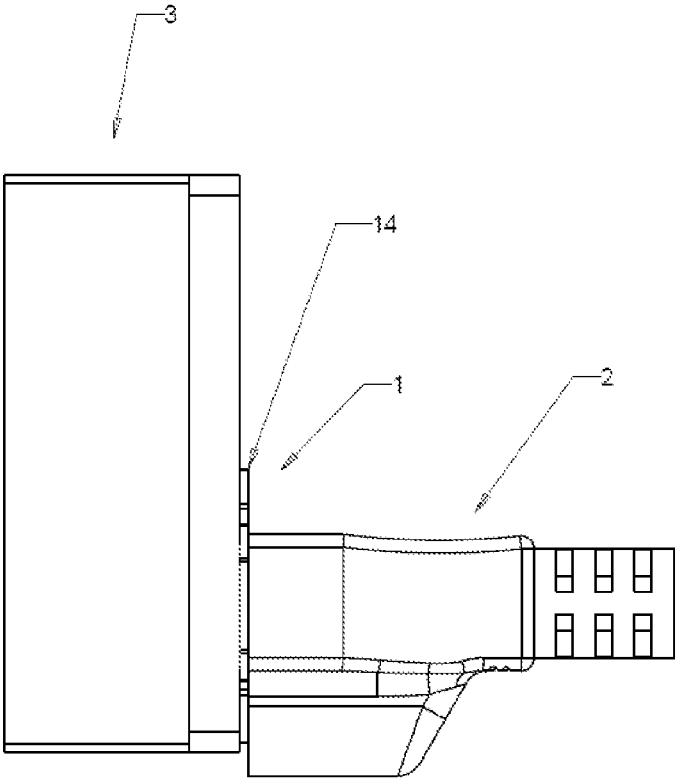
FIG. 4 is a Nema 5-15 plug with one type of safety boot installed completely inserted into an electrical outlet.

Referring now to FIG. 4, therein is shown the electrical plug 2 fully inserted in outlet 3, the base of electrical plug safety boot 1 still adhering to the plug and flaps 14 shown flattened against the outlet 3. It should be understood that the flaps can be of any shape or suitable curvature and may have folds or cuts in their surfaces and can be of any suitable dimension to maximize effectiveness or to permit greater density of electrical plugs as for example in a "power bar".

The present invention has universal adaptability in that it can be retrofitted to most existent plugs with or without a grounding prong. The simplicity of this safety boot permits the advantage of low cost manufacturing.

Figure 5:
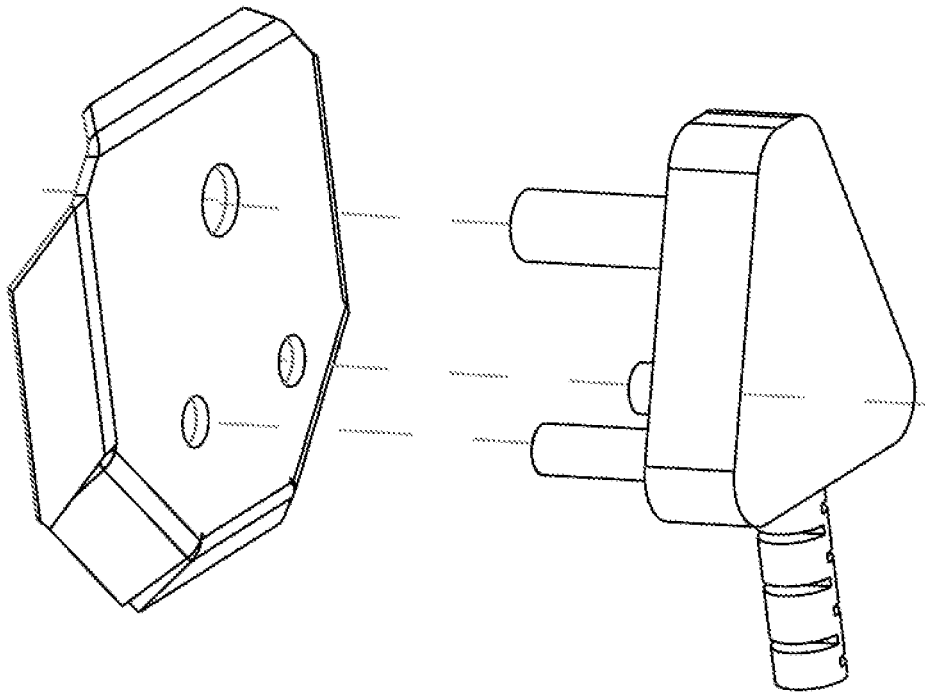
FIG. 5 is a Type M plug with one type of safety boot installed completely inserted into an electrical outlet.

FIG. 5 represents Type M plug with one type of electrical plug safety boot installed.

This invention can be distinguished from other similar inventions in that it can be retrofitted to existing plugs, whereas most other similar devices require new plugs to be manufactured to match their specific safety device.

The claimed invention is:

1. An electrically insulating safety boot with provisions to be affixed to existing or new standard electrical plugs which by flexibly interposing their surfaces which surround a set of electrical prongs, to prevent contact between the prongs and any part of the human body thereby avoiding harmful or fatal electrical shocks, particularly when the prongs may be incompletely inserted but energized, and when fully inserted in the safety boot becomes flattened such that the plug can be used without interfering in the normal use of the plug; wherein;

the safety boot consists of a first portion with multiple holes for the prongs to pass through and sit flat against the plug, and multiple flexible flaps that are attached around the first portion for folding out when the plug is inserted.

2. The safety boot of claim 1 wherein materials with different electrical and mechanical characteristics can be used for the first portion and the flaps.

3. The safety boot of claim 2 wherein the first portion of the boot which contacts the plug can be made of a rigid heat resisting material and the peripheral flap or flaps of flexible and or transparent material.

4. The safety boot of claim 1 wherein the flaps can have a second fold outside the diameter of the plug.

5. The safety boot of claim 1 wherein the boot can be affixed to the plug by means of mechanical interference fit and or pressure sensitive adhesive.

6. The safety boot of claim 1 wherein the flexible boot can be overmolded to newly manufactured plugs.

7. The safety boot of claim 1 wherein the boot can be molded out of flexible insulating material.

* * * * *